US005117926A

United States Patent [19]

Worrall et al.

[11] Patent Number: 5,117,926

[45] Date of Patent: Jun. 2, 1992

[54] METHOD AND SYSTEM FOR CONTROLLING VIBRATIONS IN BOREHOLE EQUIPMENT

[75] Inventors: Robert N. Worrall; Ivo P. J. M. Stulemeijer; Johan D. Jansen; Bartholomeus G. G. Van Walstijn, all of Rijswijk, Netherlands

[73] Assignee: Shell Oil Company, Houston, Tex.

[21] Appl. No.: 658,266

[22] Filed: Feb. 20, 1991

[30] Foreign Application Priority Data

Feb. 20, 1990 [GB] United Kingdom ..... 9003759

[51] Int. Cl.[5] ..... E21B 7/24

[52] U.S. Cl. ..... 175/56; 254/900; 367/190

[58] Field of Search ..... 175/39, 40, 321; 367/82, 83, 182; 254/277

[56] References Cited

U.S. PATENT DOCUMENTS

| | | | |
|---|---|---|---|
| 3,660,990 | 5/1972 | Zerb et al. | 175/321 |
| 3,793,632 | 2/1974 | Still | 367/182 |
| 3,813,656 | 5/1974 | Fowler | 367/82 |
| 4,206,389 | 6/1980 | Snyder | 318/317 |
| 4,535,972 | 8/1985 | Millheim et al. | 254/277 |
| 4,715,451 | 12/1987 | Bseisu et al. | 175/40 |
| 4,773,263 | 9/1988 | Lesage et al. | 175/39 |
| 4,878,206 | 10/1989 | Grosso et al. | 367/83 |

OTHER PUBLICATIONS

"Torque Feedback Used to Cure Slip-Stick Motion," by G. W. Halsey, A. Kyllingstad, and A. Kylling, SPE 18049, presented at 63rd Annual Technical Conference and Exhibition of the Society of Petroleum Engineers, held in Houston, Tex., Oct. 2-5, 1988.

*Primary Examiner*—Ramon S. Britts
*Assistant Examiner*—Frank S. Tsay

[57] ABSTRACT

Vibrations in borehole equipment are controlled by defining the energy flow through the equipment as the product of an "across" variable and a "through" variable, wherein fluctuations in one variable are measured and the energy flow is controlled by adjusting the other variable in response to the measured fluctuations in said one variable. Suitable variables for defining the energy flow are voltage times current of an electrical drive, pressure times flow rate of a hydraulic drive, or torque times angular velocity of any rotary drive.

16 Claims, 1 Drawing Sheet

FIG.1
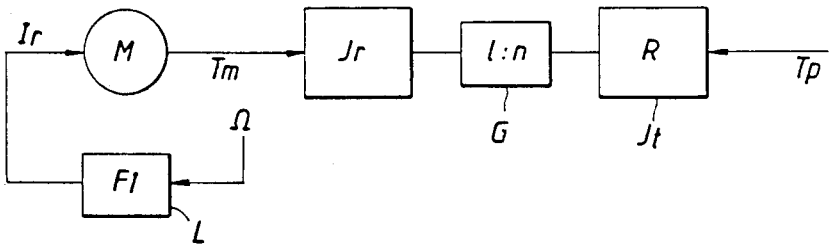
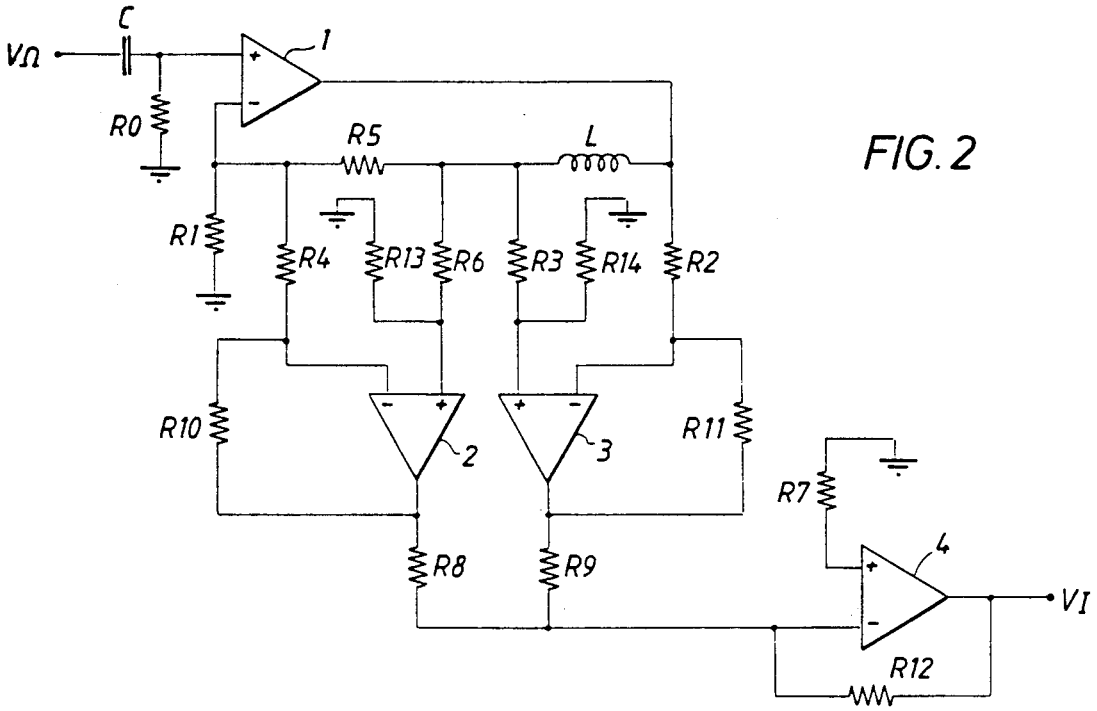
FIG. 2
FIG. 3
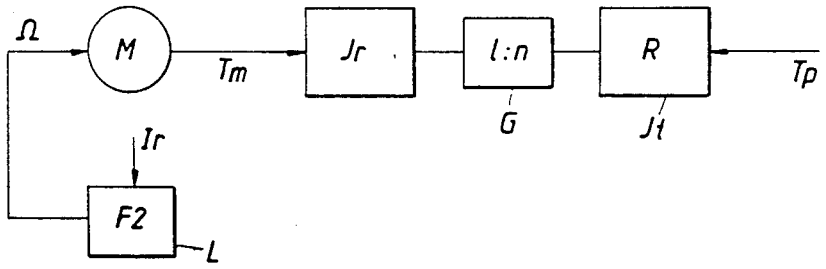
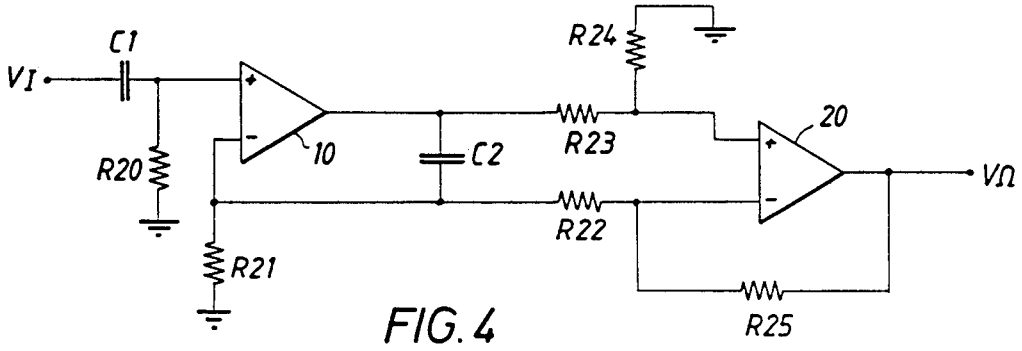
FIG. 4

METHOD AND SYSTEM FOR CONTROLLING VIBRATIONS IN BOREHOLE EQUIPMENT

BACKGROUND OF THE INVENTION

This invention relates to a method and system for controlling vibrations in borehole equipment comprising a string of tubulars and an associated drive system.

Numerous vibrations may occur in borehole equipment during well drilling or oil production operations. If the equipment includes a rotary drillstring torsional and longitudinal vibrations may be induced by alternating slip-stick motions of the drillstring alongside the borehole wall, by fluctuating bit-rock interaction forces and by pressure pulses in the drilling fluid generated by the mud pumps.

In various situations it is required to damp these vibrations in order to reduce shock loads to the equipment but in some situations it may be required to enhance these loads. for example to create a resonance jar for freeing a stuck drillpipe.

Various concepts are known in the art prior damping or enhancing vibrations in borehole equipment.

U.S. Pat. No. 4,535,972 discloses a system to control vertical movements of a drillstring with the aid of a hydraulic cylinder connected between the traveling block and the top of the drillstring. Although the known system is designed to maintain weight on bit within desired limits it is not operated as a feedback controlled vibration damper.

SPE paper 18049, "Torque Feedback Used to Cure Slip-Stick Motion," presented by G. W. Halsey et al of the Rogaland Research Institute at the Oct., 1988 SPE conference in Houston, describes a system that adapts the value of the speed of the rotary drive to a drilling assembly based on measurement of the torque at the rotary table. The known system is able to perform a rotary speed correction proportional to minus the measured torque.

However, measurement of torque at the rotary table during actual drilling operations is inconvenient and prone to failures, as it involves equipment, such as strain gauges, that is sensitive to vibrations and shockloads.

An object to the present invention is to avoid this drawback of the known system. Another object is to provide a cheap and robust method and system for controlling vibrations in borehole equipment without the need prior complex and wear-prone equipment.

SUMMARY OF THE INVENTION

The method according to the invention comprises the steps of: defining the energy flow through the borehole equipment as the product of an across variable and a through variable; measuring fluctuations in one of said variables; and controlling the energy flow by adjusting the other variable in response to the measured fluctuations in said one variable.

The method according to the invention is based on the insight that vibrations in a physical system can be expressed as variations of the energy flow through the system, and that this energy flow can always be expressed in terms of two variables, such as voltage times current, pressure times flow rate, linear velocity times force, torque times angular velocity, or generally speaking "across variable" times "through variable."

It is observed that the system disclosed in the above SPE paper varies the angular velocity of the rotary table in response to measured torque variations, but that the known system does not disclose to vary the angular velocity in such a manner that the product torque times angular velocity, or in other words the energy flow, is controlled.

Based on the insight of the present invention various vibrations in borehole equipment can be controlled in an accurate manner.

For example, if the borehole equipment is a drilling assembly comprising a rotary drillstring which is connected at its upper end to a rotary drive, torsional vibrations in the assembly can be damped by maintaining the energy flow delivered by the rotary drive to the drill string between selected limits. In other words, vibrations propagating in upward direction through the drillstring are transferred into the rotary drive and further into its power supply instead of being reflected back at the upper end of the drillstring.

If the drillstring is driven by an electric motor, the motor current can be selected as said through variable, whereas the motor voltage can be selected as said across variable.

If the drillstring is driven by a hydraulic motor, the flow rate in the motor may be selected as said through variable, whereas the fluid pressure in the motor may be selected as said across variable.

If the drillstring is driven by a diesel engine, the energy flow in the drillstring may be controlled by connecting a feedback-controlled electric or hydraulic motor-generator to the drive shaft of the engine by means of a differential.

With any kind of electric, hydraulic or mechanical rotary drive the angular velocity in a rotating part of the assembly may be selected as said across variable and the torque delivered by the top drive as said through variable, while the energy flow through the assembly may be maintained between selected limits by measuring fluctuations of said angular velocity and by inducing the torque delivered by the rotary drive to fluctuate in response to the measured velocity fluctuations.

The system according to the invention comprises: means for defining the energy flow through the borehole equipment as the product of an across variable and a through variable; means for measuring fluctuations in one of said variables; and means for controlling the energy flow by adjusting the other variable in response to fluctuations in said one variable.

DESCRIPTION OF THE DRAWINGS

FIG. 1 is a schematic representation of a rotary drilling assembly equipped with a system according to the invention which serves to control torsional vibrations.

FIG. 2 shows an electronic circuit for use in he system of FIG. 1.

FIG. 3 shows schematically a rotary drilling assembly equipped with another embodiment of a system according o the invention for controlling torsional vibrations;

FIG. 4 shows an electronic circuit for use int he system of FIG. 3.

DETAILED DESCRIPTION OF THE INVENTION

FIG. 1 illustrates schematically a rotary drillstring drive comprising a rotary table R having a polar moment of inertia $I_r$, a gearbox G having a gear reduction 1:n, and an electric motor M having a polar moment of inertia $I_n$, which motor is equipped with a vibration control system according o the invention.

The control system includes a feedback loop L which uses fluctuations in the rotary speed $\Omega$ of the upper end of the rotary drillstring as input across variable and the system controls the motor current $I_r$ in such a manner that the torque $T_m$ delivered by the motor varies in a predetermined manner in response o fluctuations in said rotary speed $\Omega$ such that the energy flow through the upper end of the drillstring is controlled such that it stays between selected limits.

In FIG. 1 $T_p$ represents the drill pipe torque.

The relationship between the measured across variable $\Omega$ and the controlled through variable $T_m$ in he active damping system of FIG. 1, such that their product $\Omega$. $T_m$ remains between selected limits has to be defined with the air of a feedback function. The definition of the feedback function strongly influences the amount of damping of the system. The amount of damping of the above described rotary drilling assembly can be quantified using the concept of mechanical impedance. Maximal damping of torsional vibrations using active damping at the rotary drive is achieved when the torsional impedance of the drive system is made equal to the characteristic torsional impedance of the drillstring. In that case minimal reflection of energy waves coming from downhole to surface will occur at the rotary table. Although in practice such a complete match cannot be obtained, it is possible to optimize the damping characteristics of the system by using an appropriate feedback function. This feedback function can be derived from the following sequence of calculations.

The torsional impedance Z of the drive system can be defined as the ratio between the amplitude $\tilde{T}_p$ of a sinusoidal moment applied at the drive system by the drillstring and the amplitude $\tilde{\Omega}$ of the resulting angular velocity of the drive system:

$$Z = \frac{\tilde{T}_p}{\tilde{\Omega}} \tag{1}$$

where:

Z = mechanical impedance $\tilde{T}_p$ = amplitude of torque in drill pipe $T_p = \tilde{T}_p e^{i\omega t}$ $\tilde{\Omega}$ = amplitude of angular velocity $\Omega = \tilde{\Omega} e^{i\omega t}$ i = imaginary unit $\omega$ = frequency t = time The torsional impedance of a rotary table driven by a DC motor with a constant stator current can be calculated as:

$$Z = i\omega J_t + n^2\left\{(i\omega \cdot J_r) + \frac{G^2 I_s^2}{R_r + i\omega L_r}\right\} \tag{2}$$

where:

$J_t$ = rotary table polar moment of inertia n = gear ratio of the gearbox between the motor and the rotary table $J_r$ = rotor polar moment of inertia G = motor constant $I_s$ = stator current $R_r$ = rotor electrical resistance $L_r$ = rotor electrical inductance The characteristic torsional impedance of the drillstring is defined as:

$$\zeta = J \cdot \sqrt{(\rho G)} = \pi/32 \cdot (D_o^4 - D_i^4)\sqrt{(\rho G)} \tag{3}$$

where:

$\zeta$ = characteristic torsional impedance

J = polar moment of inertia $\rho$ = density

G = shear modulus $D_o$ = outer diameter $D_i$ = inner diameter

On the basis of formulas (1)-(3) the following feedback function $F_1(w)$ can be defined for the feedback system shown in FIG. 1:

$$F_1(\omega) = I_r/\Omega = \left\{\frac{\zeta}{n\,G\,I_s} - i\,\frac{(n^2 J_r + J_t)\,\omega}{n\,G\,I_s}\right\} \tag{4}$$

where:

$I_r$ = controlled value of the rotor current; and $\Omega$ = measured angular velocity A suitable electronic circuit for varying the rotor current $I_n$ and motor torque $T_m$ in response to measured fluctuations in angular velocity $\Omega$ of the top of the drill stein in accordance with the above feedback function $F_1(\omega)$ is shown in FIG. 2.

The circuit of FIG. 2 comprises a high-pass filter $C.R_o$ for enabling the driller to slowly vary the rotary speed to the drilling assembly without activating the vibration control system.

The high pass filter $C.R_o$ is connected between the output $V_{106}$ of a conventional tachometer which measures the rotational speed at the top of the drill string and an input of a signal amplifier 1.

The other input of the signal amplifier is connected to earth via a first resistor $R_1$.

The circuit further comprises a positive and a negative signal amplifier 2 and 3, respectively. The inputs of the negative signal amplifier 3 are connected to the output of the signal amplifier 1 via a second resistor $R_2$ and via an induction coil L and a third resistor $R_3$ The inputs of the positive signal amplifier 2 are connected to said another input of the signal amplifier 1 via a fourth resistor $R_4$, and via a fifth resistor $R_5$ and a sixth resistor $R_6$, respectively.

The circuit further comprises a summation amplifier 4 having one input connected to ground via a seventh resistor $R_7$ and another input connected to the outputs of the differential amplifiers 2 and 3 via resistors $R_8$ and $R_9$.

Furthermore resistors $R_{10}$, $R_{11}$ and $R_{12}$ interconnect the input of each amplifier 2, 3 and 4 to one of their inputs whereas resistors $R_{13}$ and $R_{14}$ connect another input of the differential signal amplifiers 2, 3 to ground.

In the circuit of FIG. 2 $R_5$ and L are interconnected and they are the components of the circuit which represent the feedback function as $R_5$ corresponds to $\zeta$, and L corresponds to $-(n^2J_r+J_t)$ of the feedback function (4). Furthermore an electric link is provided between the output of the summation amplifier 4 and the electrical feed conduit of the motor M such that a current feedback signal $V_1$ is delivered to said conduit in response to a variation in the output signal $V_\Omega$ of the tachometer.

Note that the controlled as well as the measured variables are expressed in voltages. These voltages serve as information carriers, and should not be confused with the variables defining the energy flow which is to be controlled.

FIG. 3 illustrates schematically a rotary string drive comprising a rotary table or top drive R having a polar moment of inertia $I_t$, a gearbox G having a gear reduction 1:n, and an electric motor M having a polar moment of inertia $I_r$, which motor is equipped with a vibration control system according to the invention.

The control system includes a feed back loop L which uses fluctuations in the measured motor current $I_r$ as input through variable and the system controls the motor voltage $V_n$ such that the product $V_r I_r$, or in other words the electrical energy flow through the motor, stays between selected limits.

Again the relationship between the measured through variable $I_r$ and the controlled across variable Vr such that this product remains between selected limits has to be defined with the aid of a feedback function. The following appropriate feedback function can be derived from equations (1)-(3):

$$F_2(\omega) = \Omega/I_r + 1/F_1(\omega) = \left\{ \frac{n\,G\,I_s\,(\zeta + i\,(n^2 J_r + J_t)\omega)}{\zeta^2 + (n^2 J_r = J_t)^2\,\omega} \right\} \quad (5)$$

where:

$\Omega$ = controlled value of angular velocity $I_r$ = measured value of the rotor current This function can be simplified by assuming that $\zeta = 0$, which is justified since this parameter is much smaller than the other parameters.

A suitable electronic circuit for varying the motor voltage $V_r$ in response to measured fluctuations in the rotor current $I_r$ in accordance with the above simplified feedback function $F_2$ is shown in FIG. 4.

The circuit of FIG. 4 comprises a high pass filter $C_1$, $R_{20}$ which is connected between the output $V_l$ of the electrical feed conduit of the motor M and an input of a signal amplifier 10.

Another input of the signal amplifier 10 is connected to ground via a resistor $R_{21}$ and to an input of a differential amplifier 20 via a resistor $R_{22}$.

Another input of the differential amplifier 20 is connected to the output of the signal amplifier 10 via a resistor $R_{23}$ and to ground via resistor $R_{24}$.

Furthermore a condensor C2 interconnects said another input and the output of the signal amplifier 10 whereas a resistor $R_{25}$ interconnects said another input and the output of the differential amplifier 20.

The output of the circuit generates a volta $V_\Omega$ which varies in response to variations in the measured motor current $I_r$. The voltage $V_\Omega$ is supplied to the motor M.

From the above description with reference to the figures it will be apparent that the energy flow in a physical system can be expressed in terms of a product of an across variable times a through variable. Active damping of vibrations requires control of one of the two variables based on measurements of the fluctuations in the other, thereby transferring energy out of the vibrating system.

The following combinations of across and through variables are particularly suitable for use in a system according to the invention for controlling torsional vibrations in a drillstring:

1. Adaption of the torque delivered by an electric, mechanical or hydraulic rotary drive based on measurement of the angular velocity of any of the rotating parts at or in between the bit and the rotary drive such as the drillpipe, the rotary table, the gearbox, the drive shaft, etc.
2. Adaption of the voltage supplied to an electric rotary drive based on measurement of the current flowing through the motor or vice versa.
3. Adaption of the pressure to a hydraulic rotary drive based on measurement of the flow rate in the hydraulic motor or vice versa.

It is observed that adaption of the variables can be performed in such a way that the active damping appears as a fluctuation in the energy consumption of the rotary drive. Another way to obtain the required adaptions is to use an additional device that can both store and generate energy. For example, adaptions of the torque delivered to the rotary table by a diesel drive can be made with the aid of a feedback controlled electric motor/generator or a hydraulic motor/accumulator connected to the drive shaft by means of a differential.

It is furthermore observed that fluctuations in a variable can be measured indirectly by measuring the fluctuation in a derived variable. For example, fluctuations in velocity can be observed by measuring the displacement or the acceleration.

Furthermore, it is observed that control of a variable can also be achieved indirectly, e.g., the torque delivered by an electric motor can be controlled by controlling the rotor current.

The concept of active damping of drillstring vibrations as described above can be extended to include axial drillstring vibrations. Damping of axial vibrations is of importance during drilling as well as during tripping or running of casing. For damping of axial vibrations use can be made of the system disclosed in U.S. Pat. No. 4,535,972 to control the vertical movements of a drillstring with the aid of a hydraulic cylinder connected between the traveling block and the drillpipe Axial vibrations can also be actively damped by making use of heave compensating systems, which consist of a hydraulic system designed to compensate vertical motions of a vessel supporting a drilling rig. Another possible hydraulic device for active vibration damping consists of a telescopic part of a drillsting with an actively controlled variable extension. Such a device can be located in any part of the drillstring, i.e., above or below the ground. Furthermore, active damping of axial drillstring vibrations can be obtained by feedback controlled operation of the hoisting gear. The damping system can act at the dead line anchor using a hydraulic device, or it can act at the drive of the winch or at the brake of the winch. The concept of active damping can also be applied to the running of sucker rods and use of sucker rods to drive plunger lift pumps. The following describes possible across and through variables for the feedback control systems to be used in such active axial vibration dampers:

1. Adaption of the force supplied by the damping device (i.e., the hydraulic cylinder, the heave compensating system, the electric motor driving the winch, etc.) based on measurement of the velocity of any of the drillstring parts at or in between the bit and the damping device or vice versa.
2. Adaption of the pressure to a hydraulic damping device based on measurement of the flow rate in that device or vice versa.
3. Adaption of the voltage supplied to the electric motor driving the winch based on measurement of the current flowing through the motor or vice versa.

Another application of active damping systems can be in the damping of pressure pulses generated by pumps. This can be done by either controlling the drive of the pumps, or by using an additional device connected to the fluid system such as an actively controlled hydraulic cylinder. Active damping can now be achieved by adaption of the flow rate in the fluid system, based on measurements of the pressure in the fluid system or vice versa.

Another way to use active damping is the complete opposite of the applications described above. Now the control system provides "negative damping" and puts energy into the system rather than dissipating it. In this way the effect of tools such as resonance jars (downhole or at surface) could be drastically improved: by means of active, controlled, reflection of stress waves in the vibrating drillstring a small resonance triggered by the resonance jar can be strongly amplified.

What is claimed is:

1. A method for controlling vibrations in borehole equipment comprising a string of tubulars and an associated drive system, the method comprising the steps of:

defining the energy flow through the borehole equipment as the product of an across variable and a through variable;

measuring fluctuations in one of said variables; and controlling the energy flow by adjusting the other variable in response to the measured fluctuations in said one variable.

2. The method of claim 1 wherein the borehole equipment is a drilling assembly comprising a rotary drillstring connected at its upper end to a top drive, and torsional vibrations in the drilling assembly are damped by maintaining the energy flow delivered by the top drive to the drillstring between selected limits.

3. The method of claim 2 wherein the drillstring is driven by an electric motor, the motor current is selected as said through variable and the motor voltage is selected as said across variable, and wherein the energy flow through the output shaft of the motor is maintained between selected limits by measuring fluctuations in one of said variables and inducing the other variable to fluctuate in an opposite manner.

4. The method of claim 2 wherein the drillstring is driven by a hydraulic motor, the fluid flow rate in the motor is selected as said through variable and the fluid pressure in the motor is selected as said across variable.

5. The method of claim Z wherein the angular velocity in a rotating part of the assembly is selected as said across variable, and the torque delivered by the top drive is selected as said through variable.

6. The method of claim 1 wherein the drillstring is driven by a diesel engine and wherein the energy flow in the drillstring is controlled by connecting a feedback controlled electric or hydraulic motor-generator to the drive shaft of the engine by means to a differential.

7. The method of claim 3 wherein the torsional impedance of the drive system is substantially equal to the characteristic torsional impedance of the drillsting.

8. The method to claim 1 wherein the borehole equipment is a drilling assembly comprising a rotary drillstring connected at its upper end to a top drive and vibrations in the drillstring are reflected back by varying the energy flow delivered by the top drive to the drillsting in a predetermined patter between selected limits.

9. The method of claim 1 wherein the borehole equipment is rejected from the group consisting of elongate strings of drillpipes, casings, and sucker rods for driving plunger lift pumps and wherein longitudinal vibrations in the strain are controlled by controlling the energy flow through the string.

10. The method of claim 9 wherein the string includes an axial damping device, the force supplied by the damping device to the strings is selected as said through variable and the axial velocity of a part of the string is selected as said across variable.

11. The method of claim 9 wherein the string includes an axial hydraulic damping device, the flow rate of fluid passing through the device is selected as said through variable and the pressure of fluid in the device is selected as said across variable.

12. The method of claim 9 wherein the string is suspended from a cable that is spooled on a winch driven by an electric motor, the voltage supplied to the motor is selected as said across variable and the electric current flowing through the motor is selected as said through variable.

13. The method of claim wherein the borehole equipment includes a pipestring through which fluid is pumped by a pump and fluidic vibrations in the pipestring induced by pressure pulses generated by the pump are damped by selecting the flow rate of fluid in the string as said through variable and the pressure of fluid in the string as said across variable.

14. An apparatus for controlling vibrations in borehole equipment comprising a string of tubulars and an associated drive system, comprising:

means for defining the energy flow through the borehole equipment as the product to an across variable and a through variable;

means for measuring fluctuations in one of said variables; and means prior controlling the energy flow by adjusting the other variable in response to fluctuations in said one variable.

15. The apparatus of claim 14 wherein the borehole equipment comprises a rotary drillstring driven by an electric motor and the system includes a sensor for measuring rotational velocity in a selected part of the drillstring as said across variable and an electronic circuit for controlling the motor torque such that the energy flow through the drillstring is maintained at a substantially constant level said circuit comprising:

a signal amplifier having one input connected to the output of the sensor via a high pass filter and another input connected to earth via a first resistor;

a positive and a negative differential amplifier, the negative differential amplifier having a first and a second input, which inputs are connected to the output of the signal amplifier via a second resistor and via an induction coil and a third resistor, respectively, the positive differential amplifier having a first and a second input, which inputs are connected to said another input of the signal amplifier via a fourth resistor and via a fifth and a sixth resistor, respectively;

a summation amplifier having one input connected to ground via a seventh resistor and another input connected to the outputs of the differential amplifiers; and an electric link between the output of the summation amplifier and the electrical feed conduit of the motor.

16. The apparatus of claim 14 wherein the borehole equipment comprises a rotary drillstring driven by an electric motor and the system includes a sensor for measuring the motor torque on the basis of the consumed motor current and an electronic circuit for controlling the angular velocity of the motor such that the energy flow in the drillstring is maintained at a substantially constant level, said circuit comprising:

a signal amplifier having one input connected to the of the sensor and another input connected to ground via a first resistor;

a differential amplifier having one input connected to the output of the signal amplifier via a second resistor and another input connected to said another input of the signal amplifier via a third resistor;

a fourth resistor connecting said one input of the signal amplifier to ground;

a fifth resistor interconnecting the output and said another input of the differential amplifier; and an electric link between the output of the differential amplifier and the electrical feed conduit of the motor.

* * * * *